United States Patent [19]

Parker

[11] 4,445,404

[45] May 1, 1984

[54] REVERSIBLE RATCHET WRENCH

[75] Inventor: David L. Parker, Nogales, Ariz.

[73] Assignee: Bob Barber, Jr., Tucson, Ariz. ; a part interest

[21] Appl. No.: 328,931

[22] Filed: Dec. 9, 1981

[51] Int. Cl.[3] ..... B25B 13/46

[52] U.S. Cl. ..... 81/62

[58] Field of Search ..... 81/62, 63, 63.1, 63.2

[56] References Cited

U.S. PATENT DOCUMENTS

| | | | |
|---|---|---|---|
| 1,177,764 | 4/1916 | Dodge . | |
| 1,890,213 | 12/1932 | Cameron et al. . | |
| 2,003,346 | 6/1935 | Dodge . | |
| 2,590,387 | 3/1952 | Dodge . | |
| 4,218,940 | 8/1980 | Main | 81/177 G |
| 4,277,989 | 7/1981 | Tracy | 81/62 |
| 4,300,413 | 11/1981 | Garofalo | 81/62 |

*Primary Examiner*—James L. Jones, Jr.

*Attorney, Agent, or Firm*—J. Michael McClanahan

[57] ABSTRACT

A new improved reversible ratchet wrench completely operable by one hand having the improvement operably attached to one side of the double-ended pivotable pawl engaging the ratchet wheel attached to the square shaped stud adapted to receive a socket, the improvement comprising an extension rod slidably situated along the mid-section of the reversible wrench pivotally connected at one end to the double-ended pawl, the extension rod other end terminating in a thumb control button, said thumb control button operable simultaneously with the operator's hand grasping the handle of the reversible wrench. By manipulation of one hand, the direction in which the wrench will ratchet in may be selected or reversed, or a central neutral position where the pawl does not engage the ratchet wheel may be chosen whereupon the ratchet wrench is completely free of engagement of the socket.

1 Claim, 3 Drawing Figures

REVERSIBLE RATCHET WRENCH

BACKGROUND OF THE INVENTION

Reversible ratchet wrenches have been available to the public for a rather long period of time. For example, John H. Dodge was granted U.S. Pat. No. 1,177,764 in 1916 upon a ratchet wrench of the type that could be converted to either a right-hand or a left-hand wrench, i.e., reversible, by means of a half-turn of an extension rod running to the bottom of the handle.

Various improvements have appeared on the reversible ratchet wrench since such time, such as differing means for reversing the pawls for reversing direction of the ratchet. J. S. Dodge in U.S. Pat. No. 2,003,346, shows an improvement in a pawl-reversing device. Similarly, J. S. Dodge in U.S. Pat. No. 2,590,387, discloses further improvements for a pawl reversing scheme.

The ratchet reversing wrenches presently available and as cited above all have the same inherent disadvantage and that is that in order to reverse the direction of the ratchet, it is necessary that the operator using the reversible ratchet wrench remove his hand from a position gripping the handle of the wrench to reverse the ratchet direction if one hand is to be used solely, or, if the operator wishes to continue gripping the handle with one hand, then the operator is required to use the other hand to reverse the ratchet reversing pawls. The reason for this is in all reversible ratchet wrenches known to the inventor, the pawl reversing mechanism is either at the bottom of the handle or at the top socket receiving portion of the wrench. In both cases, two hands are necessary to simultaneously grasp the wrench and change its direction.

Many situations can be envisioned where direction of the reversible ratchet wrench is desired or necessary while continuing to hold the ratchet handle, but where the operator's other hand is either not available to change the ratchet direction or where the socket receiving portion of the ratchet wrench is in a position not accessible by any hand.

SUMMARY OF THE INVENTION

The present invention comprises a unique reversible ratchet wrench wherein means are provided to conveniently reverse the ratchet direction of the wrench through a pawl reversing means which is accessible to the hand of an operator gripping the handle.

In accordance with the invention, the pawl reversing means which reverses the direction of the ratchet wrench, utilizes a slidable thumb control button located in the mid-section of the wrench immediately above the wrench handle. In this regard, the slidable thumb control is attached to an extension rod which tunnels through the mid-section of the reversible wrench to attach pivotally to one side of the pivotable direction reversing pawl. Relative positions of the sliding thumb control button indicate the position of the direction reversing pawl to inform the operator at a glance whether the ratchet is operating in the right hand, the left hand, or is in a neutral position. The slidable thumb control button moves in a channel formed in the mid-section of the wrench.

Accordingly, it is an object of the present invention to provide a means by which an operator may change the direction, or select a neutral position of a reversible ratchet wrench, without having to utilize a second hand other than the hand holding the wrench.

It is another object of the subject invention to provide a reversible ratchet wrench where the ratchet direction changing means is accessible to the hand of the operator holding the wrench handle such that the operator need not give up his grip upon the handle.

Still further, it is an object of the subject invention to provide a reversible ratchet wrench wherein the means to reverse the direction of the wrench are accessible to an operator's thumb or finger of the hand holding the handle of the ratchet wrench.

DETAILED DESCRIPTION OF THE PREFERRED EMBODIMENT

Figure 1:
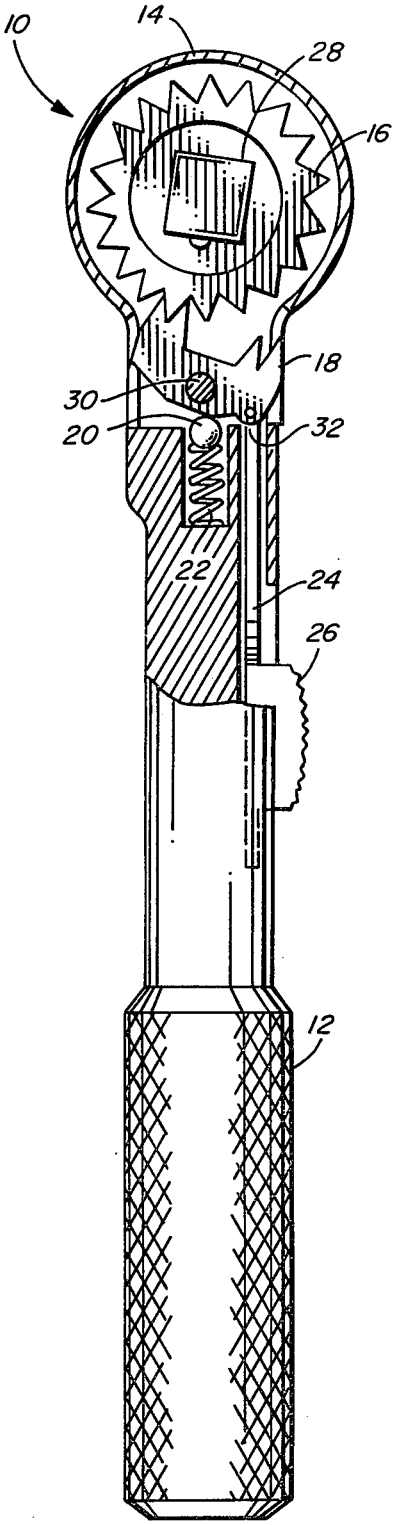
FIG. 1 is a front view of the subject invention with the ratchet reversing mechanism exposed.

Referring now to FIG. 1, a front view of the subject invention is shown. In the view shown, the top of the case covering the ratchet wheel has been removed for ready visibility of the functioning parts of the subject reversible ratchet wrench. Beginning firstly at the bottom, handle 12 provides a means by which a mechanic grasps the wrench holding it with the fingers curled around the handle and the thumb pointed upward. Nominally the handle 12 is knurled in order to provide a non-slip situation. Moving upward, the reversible ratchet wrench 10 narrows from the handle portion into a mid-section portion until the wrench reaches the upper socket receiving portion 14 which houses circular ratchet wheel 16 and double-ended pawl 18 together with co-acting spring loaded ball bearing 20. Spring 22 acts directly upon ball bearing 20.

Pivotally connected to one side of double-ended pawl 18 is extension rod 24 which in turn is connected to thumb control button 26.

As is well known, ratchet wheel 16 is rotatably mounted in the socket receiving portion 14, with square sided socket receiving stud 28. Double-ended pawl 18, which is pivoted about centrally located axle 30, is so situated that one of three pivotal positions may be chosen by the operator, depending on what is desired. Firstly, the pawl may be placed in the position shown in FIG. 1 which will permit free rotation of the ratchet wheel in a clockwise direction since the tooth of the ratchet wheel, in turning clockwise, is permitted to push double-ended pawl 18 slightly downward and allow the engaged tooth to pass out of the two teeth of the pawl. However, should an attempt be made to rotate ratchet wheel 16 counter clockwise, the tooth of the ratchet wheel presently engaged by double-ended pawl 18 attempts to pull pawl 18 more into a locked position against the tooth and rotation in that direction is inhibited. Similarily, double-ended pawl 18 may be placed into its opposite position with the right handed side pair of teeth engaging one of the teeth of ratchet wheel 16, in which case rotation only in the counter clockwise direction is permitted.

Thirdly, double-ended pawl 18 may be rotated to a central position where neither teeth at either end of pawl 18 are engaging ratchet wheel 16 teeth and in which case, ratchet wheel 16 will rotate freely in either direction.

Noted immediately below double-ended pawl 18 is ball bearing 20 which engages pawl 18 on either side of the angle formed central to the lower portion of pawl 18. As it can be seen, ball bearing 20 rests on one side of the angle when one set of its teeth are engaging ratchet wheel 16. In the case of the other set of the pawl 18 teeth engaging ratchet wheel 16, the ball bearing 20 will be resting on the other side of the angle formed on pawl 18. For the situation with the pawl 18 located in a strictly horizontal position, i.e., no teeth of pawl 18 engaging ratchet wheel 16, ball bearing 20 then will rest on the very point of the angle of double-ended pawl 18. It has been found helpful to place a small flat spot on the point of pawl 18 for ball bearing 20 to rest. With this type of arrangement, the pawl 18 would be less inclined to be pivoted to one side or the other by the ball bearing if the wrench is jarred or otherwise distrubed.

As shown in FIG. 1, ball bearing 20 is urged against pawl 18 by means of spring 22, the total assembly of ball bearing 20 and spring 22 being placed into a blind hole drilled in the lower portion of the socket receiving portion of the subject reversible ratchet wrench 10.

Continuing, shown attached in pivotal relationship to one side of double-ended pawl 18 is extension rod 24, which in turn is also connected to thumb control button 26. Thumb control button 26 and extension rod 24 are in sliding relationship to the mid-section portion of the reversible ratchet wrench 10, thumb control button 26 slidable along a channel immediately above handle 12 (see also FIG. 2).

As is obvious, merely by sliding thumb control button 26 upward, double-ended pawl 18 is pivoted about axle 30 and, in doing so, removes the pawl teeth engaging ratchet wheel 16 from position shown. Now, the other set of teeth on pawl 18 can engage ratchet wheel 16 teeth or, double-ended pawl 18 may lay in a horizontal, non-engaging position. Thumb control button 26 is freely movable in an up or down direction, double-ended pawl 18 responding accordingly to such movement.

Attached to double pawl 18 are a pair of ears 32, there also being a pin piercing both ears 32 and extension rod 24, thereby holding extension rod 24 in pivotal connection to the ears 32 and hence double-ended pawl 18.

Figure 2:
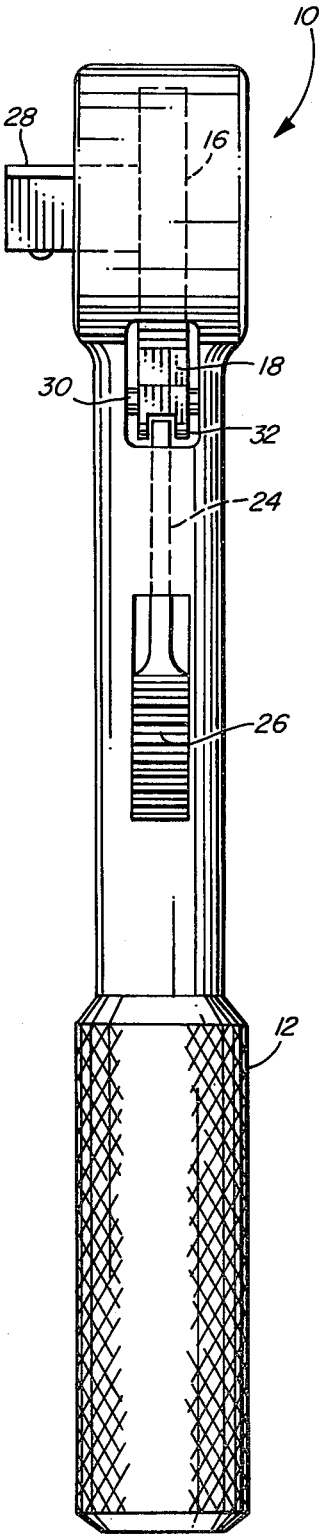
FIG. 2 is a side view of the subject invention.

Referring now to FIG. 2, a side view of the subject reversible ratchet wrench 10 is detailed. Again starting from the bottom, handle 12 provides a means by which the wrench 10 may be held. Immediately above handle 12 the top of thumb control button 26 is seen within a channeled slide area which permits thumb control button 26 to move forward and back. Thereafter, extension rod 24 connected to thumb control button 26 passes through a tunnel formed lengthwise in the mid-section of wrench 10 and emerges to be pivotally connected to ear 32 of double-ended pawl 18. Shown more clearly in FIG. 2 than FIG. 1, axle 30 permits pivotal movement of pawl 18, the teeth of which are shown engaging the teeth of ratchet shell 16. As earlier described, socket receiving stud 28 is attached directly to ratchet wheel 16 so that when pawl 18 is engaged, rotational movement of handle 12 in one direction translates into the rotational movement of the socket receiving means 28.

In operation, the subject inventive reversible ratchet wrench with the improvements shown permits an operator with one hand to change the direction of the rotational movement of the ratchet wheel, and thus the socket receiving stud, merely by utilizing the thumb control button. In this position, it is not necessary for the operator to use his other hand to change ratcheting direction as is common in all other wrenches, or, to release his grip of handle 12 if a change is to be effected with the same hand. This is especially helpful where the socket receiving portion of the reversible ratchet wrench is possibly in an inaccessible location when the requirement to change ratcheting direction is necessary and the operator can not remove the reversible ratchet wrench and socket from its position, or perhaps the operator's other hand may be holding a nut receiving the bolt that the socket is attached to. Many situations can be envisioned where both the operator's hands are occupied and the need for reversing the ratcheting direction arises.

Other advantages of the subject invention is that by observation of the relative position of the thumb control, the operator can easily ascertain in which position the pawl is located so that the operator will always at a glance, have the correct ratcheting direction set before the wrench is applied for use.

Figure 3:
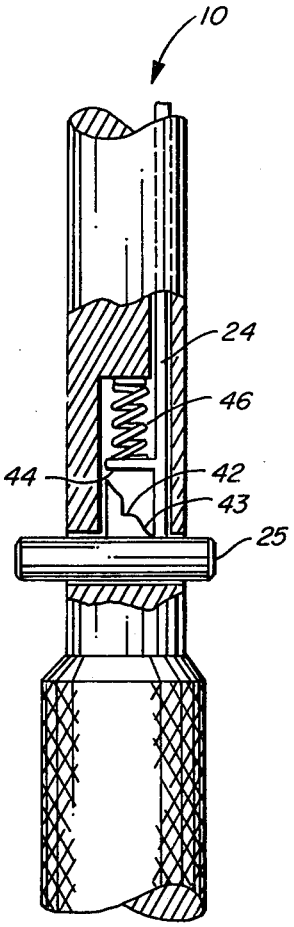
FIG. 3 is a front view of an alternate embodiment of the invention showing a push button means for reversing the direction of the reversible ratchet wrench.

Referring now to FIG. 3, an alternate embodiment of the subject invention is shown wherein a cutaway view of the mid-section of reversible ratchet wrench 10, means are shown for providing a thumb controlled push-button type ratchet wheel directional selector.

As seen in FIG. 3, push-button 25 penetrates transversely through the mid-section of reversible ratchet wrench 10 and engages a modified extension rod 24. By means of a perpendicular tang 44 attached to extension rod 24, spring 46 is always urging extension rod 24 to the rear to engagement with the side of the elongated shank of push-button 25. Shown formed in the shank of push-button 25 is a sloped portion 43 rising in the direction of extension rod 24 with a notch 42 located approximately centrally located in slope 43. The function of slope 43 is to urge extension rod 24 against spring 46 and towards the top socket receiving portion of wrench 10 when the push-button is pushed left to right. This accomplishes the same function as pushing the thumb control button 26 of FIGS. 1 and 2 towards the socket receiving portion of the wrench. The notch 42 formed in slope surface 43 is adapted to receive the end of extension rod 24 and hold it in place when it is desired that the teeth of double-ended pawl 18 should not engage the teeth of ratchet wheel 16. This is a neutral position which allows the ratchet to slip freely. Continued urging of push-button 25 from left to right then allows extension rod 24 to further ride up on the slope surface 43 to select the opposite direction by which the ratchet wheel is to turn.

Returning push-button 25 to its original position shown in FIG. 3, through the action of spring 46 upon extension rod 24, allows pawl 18 to pivot back to its original position allowing the first of the two sets of teeth of pawl 18 to engage ratchet wheel 16.

While a preferred embodiment of the invention has been shown and described, together with one alternate embodiment, it is appreciated that the scope of the invention is not to be limited except as defined in the appended claims.

I claim:

1. An improvement in reversible ratchet wrenches of the type having in its upper portion a ratchet wheel attached to the square shaped stud adapted to receive a socket, a double ended spring loaded ratchet reversing pivotal pawl adapted to pivot and thereby engage the ratchet wheel with one end or the other and thereby effect a reversal, a mid-section portion connecting to the upper portion, and having a handle to be held by the operator's hand connecting to the mid-section, the improvement comprising an extension rod pivotally connected at one end to the pivotal pawl and a direction reversing push-button assembly penetrating transversely the mid-section portion proximate the handle, said push-button assembly defining a ramp engaged by said extension rod second end, said ramp further including a notch situated mid-range, said notch adapted to be engaged by said extension rod mid-way in said extension rod's linear travel between reversing positions in order to effect a neutral position of the pivotal pawl not engaging the ratchet whereby the operator may reverse the ratchet direction with the same hand maintaining a grip on the handle.

* * * * *